United States Patent [19]

Czerwinski et al.

[11] Patent Number: 4,776,366

[45] Date of Patent: Oct. 11, 1988

[54] GASEOUS FUELED TORCH APPARATUS AND FUELING MODULE THEREFOR

[75] Inventors: Kenneth S. Czerwinski, Detroit; Eugene Gabany, Taylor; Shanti S. Sharma, Bloomfield Hills; John W. Turko, River Rouge, all of Mich.

[73] Assignee: Michigan Consolidated Gas Company, Detroit, Mich.

[21] Appl. No.: 797,438

[22] Filed: Nov. 13, 1985

[51] Int. Cl.[4] ..... F16K 49/00

[52] U.S. Cl. ..... 137/334; 137/883; 141/44; 141/54; 141/234; 417/33; 417/307

[58] Field of Search ..... 48/190–192, 48/196; 137/334, 343, 557, 883; 417/33, 46, 47, 63, 307, 442; 418/DIG. 1; 141/37, 44, 52, 54, 77, 234, 237

[56] References Cited

U.S. PATENT DOCUMENTS

| | | | |
|---|---|---|---|
| 1,762,260 | 6/1930 | Motte et al. | 48/192 |
| 1,943,059 | 1/1934 | Dana | 62/1 |
| 2,075,408 | 3/1937 | Sholes | 62/1 |
| 2,399,723 | 5/1946 | Crowther | 260/676 |
| 2,663,626 | 12/1953 | Spangler | 48/190 |
| 2,681,167 | 6/1954 | Weisz | 222/1 |
| 2,712,730 | 7/1955 | Spangler | 62/1 |
| 2,739,607 | 3/1956 | Murray | 417/307 |
| 2,741,987 | 4/1956 | Murphy et al. | 417/33 |
| 2,882,243 | 4/1959 | Milton | 252/455 |
| 3,021,689 | 2/1962 | Miller | 62/192 |
| 3,565,201 | 2/1971 | Petsinger | 180/54 |
| 3,688,755 | 9/1972 | Grayson et al. | 123/127 |
| 3,719,196 | 3/1973 | McJones | 137/110 |
| 3,807,422 | 4/1974 | McJones | 137/12 |
| 3,837,377 | 9/1974 | McJones | 141/4 |
| 3,844,306 | 10/1974 | Hill | 137/256 |
| 3,847,173 | 11/1974 | Hill | 137/110 |
| 3,850,009 | 11/1974 | Villadsen | 62/473 |
| 3,906,915 | 9/1975 | Bednarczyk et al. | 123/127 |
| 3,926,168 | 12/1975 | Csicsery | 123/180 R |
| 3,960,769 | 6/1976 | Munzner et al. | 252/444 |
| 4,010,623 | 3/1977 | Kaschak | 62/55 |
| 4,016,836 | 4/1977 | McKay et al. | 123/3 |
| 4,046,709 | 9/1977 | Yuki | 252/421 |
| 4,139,019 | 2/1979 | Bresie et al. | 137/351 |
| 4,178,882 | 12/1979 | Anderson et al. | 123/1 A |
| 4,225,320 | 9/1980 | Gell | 48/191 |
| 4,227,497 | 10/1980 | Mathieson | 123/525 |
| 4,253,428 | 3/1981 | Billings et al. | 123/1 A |
| 4,287,166 | 9/1981 | Dwyer et al. | 423/325 |
| 4,341,234 | 7/1982 | Meinass et al. | 137/110 |
| 4,343,770 | 8/1982 | Simons | 422/112 |
| 4,531,558 | 7/1985 | Engel et al. | 141/44 |

OTHER PUBLICATIONS

"Sorbent-Containing Storage Systems For Natural Gas Powered Vehicles", by Amos Golovoy, Ford Motor Company, Dearborn, Mich.

"Properties of Natural Zeolites"–U.S. Dept. of the Interior, RI 7744, Bureau of Mines Report of Investigations/1973.

"Natural Gas Storage With Zeolites", by Ronald A. Munson and Robert A. Clifton, Jr.–Bureau of Mines Nonmetallic Minerals Program, U.S. Dept. of Interior 8/71.

(List continued on next page.)

*Primary Examiner*—Samuel Scott
*Assistant Examiner*—Noah Kamen
*Attorney, Agent, or Firm*—Harness, Dickey & Pierce

[57] ABSTRACT

The disclosed gaseous fuel torch apparatus is adapted for use in cutting, welding, heating or other such operations involving the heating, cutting, or fusing of either metallic or non-metallic materials. The apparatus includes a fueling module for supplying gaseous fuel to a torch at an elevated pressure from a relatively low pressure gaseous fuel source, such as a natural gas supply system for example. The fueling module also preferably includes a selectively-operable alternate system for supplying such compressed gaseous fuel for other applications, including the recharging of one or more storage vessels for example. The fueliing module includes features by which its gaseous fuel discharge pressure can be infinitely varied and preselectively adjusted within the capabilities of the fueling modules's compressor device.

11 Claims, 3 Drawing Sheets

OTHER PUBLICATIONS

"Natural Zeolites: Their Properties, Occurrences, and Uses"-R. A. Munson and R. A. Sheppard, Minerals Science and Engineering-Jan. 1974.
"Low Pressure Methane Storage System For Vehicles-Preliminary Concept Evaluation"-J. Braslaw, J. Nasea, Jr. and A. Golovoy, Ford Motor Co. MI 1/82.
"Hydrogen As An Automotive Fuel": by Jim Epperson, Michigan Technic-Apr. 1974 (pp. 6-7).
"Compressed Natural Gas (CNG): A Vehicle Fuel For Utility Company Fleets-The Pros and Cons"-American Gas Association-Feb. 1982.
"Assessment of Methane-Related Fuels For Automotive Fleet Vehicles"-U.S. Dept. of Energy-Feb. 1982, pp. 2-1 through 2-41; 3-1 through 3-21; and 9-1 through 9-4. (vol. 2 of 3 Volumes).
"Assessment of Methane-Related Fuels for Automotive Fleet Vehicles"-U.S. Dept. of Energy-Feb. 1982-pp. D1 through D6 (vol. 3 of 3 Volumes).
"Assessment of Methane-Related Fuels for Automotive Fleet Vehicles"-U.S. Dept. of Energy-Feb. 1982-vol. 1 of 3 Volumes.
"State-of-the-Art Assessment of Methane-Fueled Vehicles"-U.S. Dept. of Energy, Feb. 1982-DOE/-CE-0026.
"Adsorption of Methane On Active Carbons and Zeolites" by K. Otto, Ford Motor Company, Dearborn, Mich.
"Are Other Concepts Pushing Diesels Into Background At Ford?" by Al Wrigley-Automotive Diesel Progress, Aug. 1981.
S.A.E. Technical Paper 830382, "On-Board Storage and Home Refueling Options for Natural Gas Vehicles" by A. Golovoy and J. Braslaw, published and presented by S.A.E. International Congress & Exposition in Det., MI 2/28-3/4/83.
"The Quest For Alternative Fuels" Detroit Engineers, Nov. 1983, pp. 6-9.

GASEOUS FUELED TORCH APPARATUS AND FUELING MODULE THEREFOR

BACKGROUND AND SUMMARY OF THE INVENTION

The invention relates generally to various torch or torch-like apparatus for cutting, welding, or heating operations involving either metallic or non-metallic materials. More specifically, the invention relates to a fueling apparatus for supplying fuel to such torch or torch-like apparatuses. As used herein, the general term "welding", includes welding, brazing, or other known operations by which separate items or pieces of material are joined or fused to one another with the use of flame-producing torch or burner.

Cross-reference is hereby made to U.S. Pat. No. 4,531,558, issued July 30, 1985, U.S. Pat. No. 4,523,548, issued June 18, 1985, and U.S. Pat. No. B 4,522,159, issued June 11, 1985, all of which are owned by the same assignee as the present invention herein and which are hereby incorporated by reference herein.

Various torches, burners, or other flame-producing devices are well-known for use in various operations, such as the welding, cutting or heating of various objects or various materials, including either metallic or non-metallic materials. Such torch or torch-like devices produce a flame upon the combustion of a mixture of air or other oxygen-containing gases with a suitable fuel. Typically, such suitable fuels include a variety of fuels such as propane, acetylene, natural gas, or other hydrocarbon gaseous fuels.

The fuels for use in the above-mentioned operations are generally provided in storage tanks or vessels that are connectable to the torch apparatus. Because of the necessity for purchasing and transporting such fuels in pre-filled storage vessels, or for refilling and transporting previously-existing storage vessels, the provision of such fuels for the various operations described above is frequently very expensive and inconvenient in many applications. Furthermore, because of the differing operating pressures and other parameters associated with the above-mentioned operations, such fuels are frequently required to be supplied to the torch or torch-like apparatus at different flow rates or at different pressures, thereby resulting in incompatibility or non-exchangeability of equipment among some of the above-mentioned operations.

It is therefore one of the primary objectives of the present invention to provide for a fueling apparatus or a module is adapted for use in supplying a fuel to a torch or torch-like apparatus from a convenient, readily-available, and inexpensive source of said fuel, such as natural gas, for example.

Another of the primary objectives of the present invention is to provide such a fueling apparatus or module capable of delivering a gaseous fuel, such as natural gas, at a wide variety of flow rates and pressures, thereby being compatible and interchangeable among a wide variety of welding, cutting or heating operations.

Still another objective of the present invention is to provide such a fueling apparatus or module capable of being connected to a relatively low pressure gaseous fuel supply source, such as a typical residential or commercial natural gas supply system.

A further objective of the present invention is to provide such a fueling apparatus or module that is relatively inexpensive, simple and convenient to use, relatively inexpensive to manufacture, and that is preferably portable in order to maximize its use in a wide variety of locations.

Another objective of the present invention is to provide such a fueling apparatus or module capable of fueling a torch or torch-like apparatus directly from a readily-available gaseous fuel source, as well as being usable for recharging pre-existing gaseous fuel storage tanks for subsequent use in remote locations where no gaseous fuel source is available.

According to the present invention, a fueling module is provided for supplying a gaseous fuel to a torch or other torch-like device at an elevated pressure from a relatively low pressure gaseous fuel source, such as a residential or commercial natural gas supply system, for example. An exemplary fueling module according to the present invention preferably includes an inlet readily connectable in fluid communication with the source of the gaseous fuel, a compressor for compressing gaseous fuel from the gaseous fuel source in order to increase its pressure, and a fueling module discharge selectively and releasably connectable to the torch for selectively supplying the compressed gaseous fuel thereto, including an adjustable regulator device for preselectively adjusting the pressure of the compressed gaseous fuel supplied to the torch. Preferably, the fueling module according to the present invention also includes a second, alternate fueling module discharge system for selectively bypassing the above-mentioned adjustable regulator device in order to discharge the compressed gaseous fuel directly from the compressor for purposes of recharging one or more gaseous fuel storage vessels, for example.

Various embodiments of the fueling module according to the present invention can include one or all of a variety of optional, but preferred, features, such as a filter for filtering the gaseous fuel between the fueling module inlet and the compressor intake, a lubricant filter for trapping and collecting compressor lubricants from the compressed gaseous fuel from the compressor discharge outlet, a return system for returning the compressor lubricants to the intake of the compressor, a cooling device for reducing the temperature of the compressed gaseous fuel from the compressor discharge outlet, or a selectively operable valve system for selectively discharging the compressed gaseous fuel either through the above-mentioned adjustable regulator device or substantially directly from the compressor. Other optional, but preferred, features include an adjustable pressure cut-off device for pre-setting the maximum compressor discharge pressure and an adjustable relief valve system for pre-setting the pressure limit on the above-mentioned adjustable regulator device.

Additional objects, advantages and features of the present invention will become apparent from the following description and appended claims, taken in conjunction with the accompanying drawings.

DETAILED DESCRIPTION OF THE PREFERRED EMBODIMENTS

Figure 1:
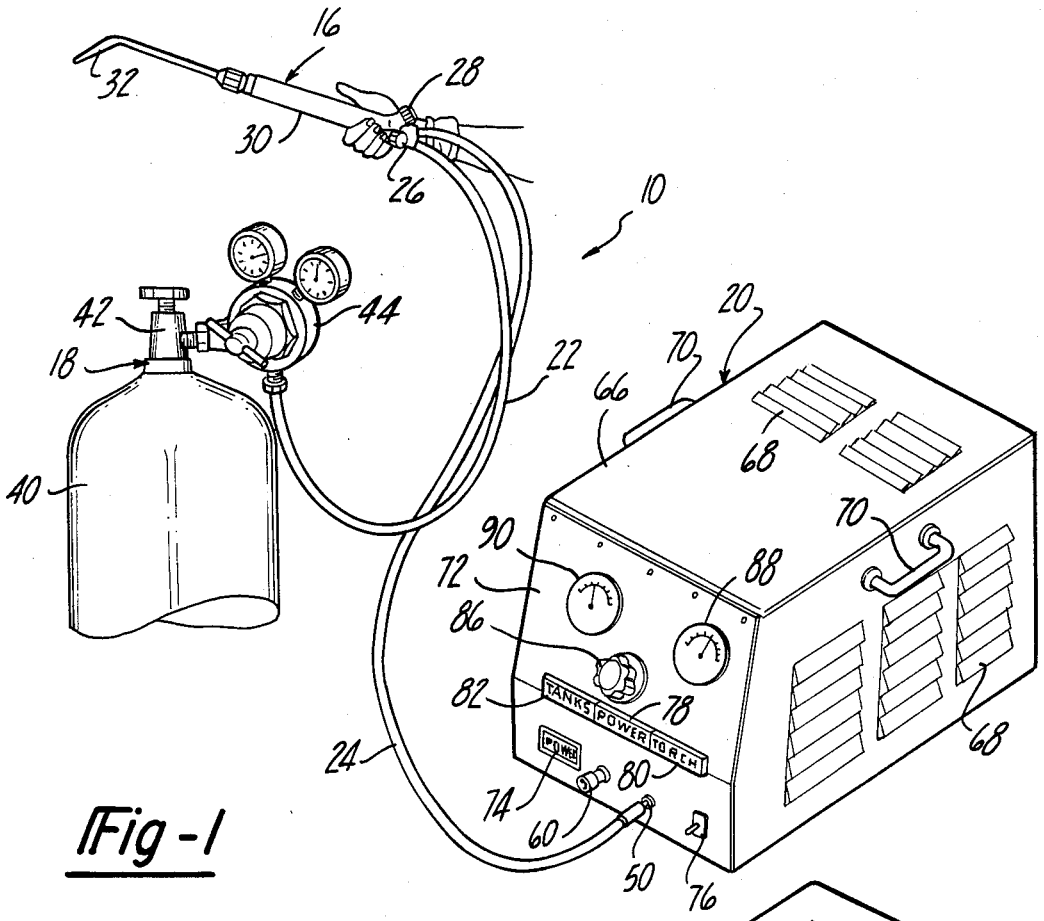
FIG. 1 is a perspective view of a gaseous fuel torch apparatus according to the present invention, including an exemplary fueling module connected for supplying a gaseous fuel to a torch device.

FIGS. 1 through 4 depict an exemplary embodiment of a gaseous fuel torch apparatus in accordance with the present invention, including an exemplary fueling module adapted for alternate use in supplying a gaseous fuel, such as natural gas for example, to a torch device, or for optionally recharging one or more gaseous fuel storage vessels or tanks. One skilled in the art will readily recognize from the following discussion and the accompanying drawings that the principles of the invention are equally applicable to torch apparatuses and fueling modules other than those shown for purposes of illustration in the drawings. It will also be readily apparent from the following discussion and the accompanying drawings that the present invention is adaptable to a wide variety of applications in addition to the torch supply and storage vessel supply applications shown for purposes of illustration in the drawings.

In FIG. 1, a gaseous fuel torch system 10 generally includes a torch assembly 16, an oxygen supply apparatus 18, and a fueling module 20, with an oxygen supply conduit 22 interconnecting the oxygen supply apparatus 18 with the torch assembly 16, and with a fuel supply conduit 24 interconnecting the fueling module 20 with the torch assembly 16. The torch assembly 16 shown in FIG. 1 is typical and representative of any of a wide variety of well-known torch assemblies commonly used in cutting, welding, or heating operations of various types. The torch assembly 16 generally includes an oxygen valve 26 and a fuel valve 28 for variably adjusting the fuel-and-oxygen mixture in a mixing portion 30 in order to produce a flame at a torch tip 32 upon combustion of the air-and-fuel mixture. Although not specifically shown in FIG. 1, the torch assembly 16 can preferably include a reducing regulator for fine-tuning of the fuel supply by the user of the torch.

Like the torch assembly 16, the oxygen supply apparatus 18 is typical and representative of any of a wide variety of well-known oxygen supply devices commonly used in cutting, welding, or heating operations. The oxygen supply apparatus 18 generally includes an oxygen tank 40, a shut-off valve 42, and an oxygen regulator device 44 for monitoring and adjusting the oxygen supply pressure and flow rate.

Figure 2:
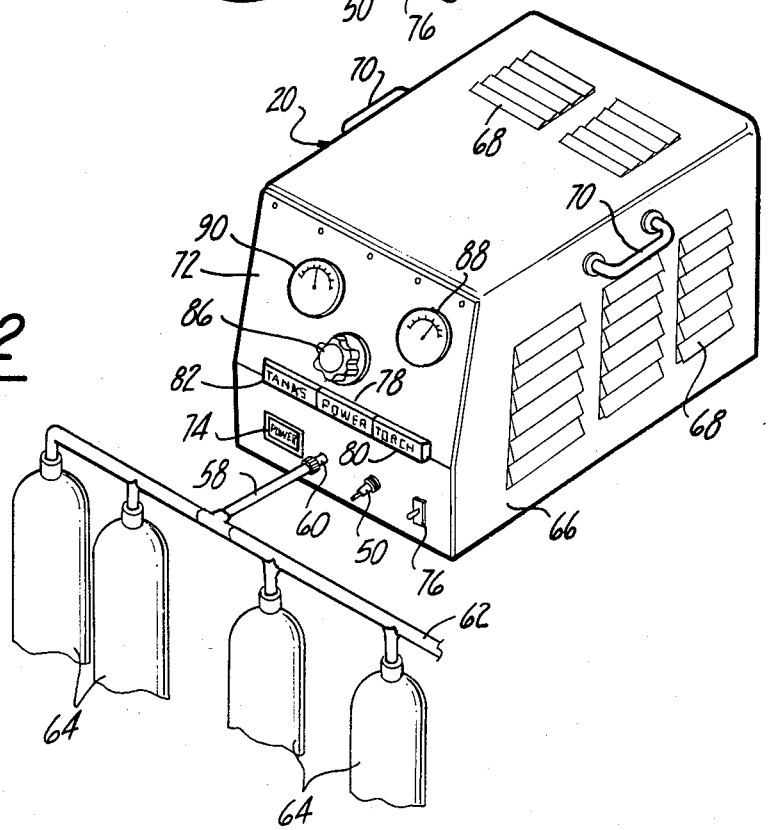
FIG. 2 is a perspective view similar to that of FIG. 1, but illustrating the exemplary fueling module of FIG. 1 connected for supplying gaseous fuel for recharging one or more gaseous fuel storage vessels.

As shown in FIGS. 1 and 2, the fueling module 20 is adaptable for supplying a gaseous fuel to the torch assembly 16 through the fuel supply conduit 24, which is releasably connectable to the fueling module 20 by way of a quick-connect torch discharge fitting 50, or alternately and selectively adaptable for other purposes such as that shown in FIG. 2. In FIG. 2, a recharging conduit 58 is releasably connectable to a quick-connect tank discharge fitting 60 for supplying gaseous fuel through a manifold 62 to one or more storage vessels 64. By such an arrangement, the fueling module 20 also has indirect utility in torch apparatus applications at remote locations where no electrical power source or gaseous fuel supply source is available, thereby allowing one or more of the storage vessels 64 to be recharged, transported, and used for gaseous fuel supply at such locations. It should be noted, as is readily apparent to one skilled in the art, that the fueling module 20 can also be used for alternate gaseous fuel supply applications other than storage vessel recharging as shown for purposes of illustration in FIG. 2.

It should also be noted that the storage vessels 64 preferably contain a sorbent (adsorbent or absorbent) material in order to increase their gaseous fuel storage capacity. Examples of such storage tanks are disclosed in the above-mentioned U.S. Patents (incorporated by reference herein), and examples of the sorbent materials include activated carbon, zeolite materials, silica gel-type materials, or various clays.

The fueling module 20 generally includes a housing 66 equipped with one or more ventilation louvers 68, one or more carrying handles 70, and a control panel 72. The control panel 72 includes a main power switch 74 for energizing and de-energizing the fueling module 20, and a selector switch 76 for preselecting either of the modes of operation shown in FIGS. 1 and 2. The control panel 72 also includes a power indicator light 78 for indicating to the user that the main power switch is in an "on" position, a torch indicator light 80 for indicating the selection of the torch application shown in FIG. 1, and a tank indicator light 82 for indicating the selection of the tank recharging or other such application shown in FIG. 2. A torch pressure regulator control 86 is also provided on the control panel 72 for allowing the user to selectively regulate the gaseous fuel supply pressure in the torch apparatus application shown in FIG. 1. A torch pressure gauge or indicator 88 is provided on the control panel 72 for monitoring the gaseous fuel discharge pressure in the torch mode, and a similar tank pressure gauge or indicator 90 is provided for monitoring the gaseous fuel discharge pressure in the mode of operation for recharging storage vessels or other such purposes.

Figure 3:
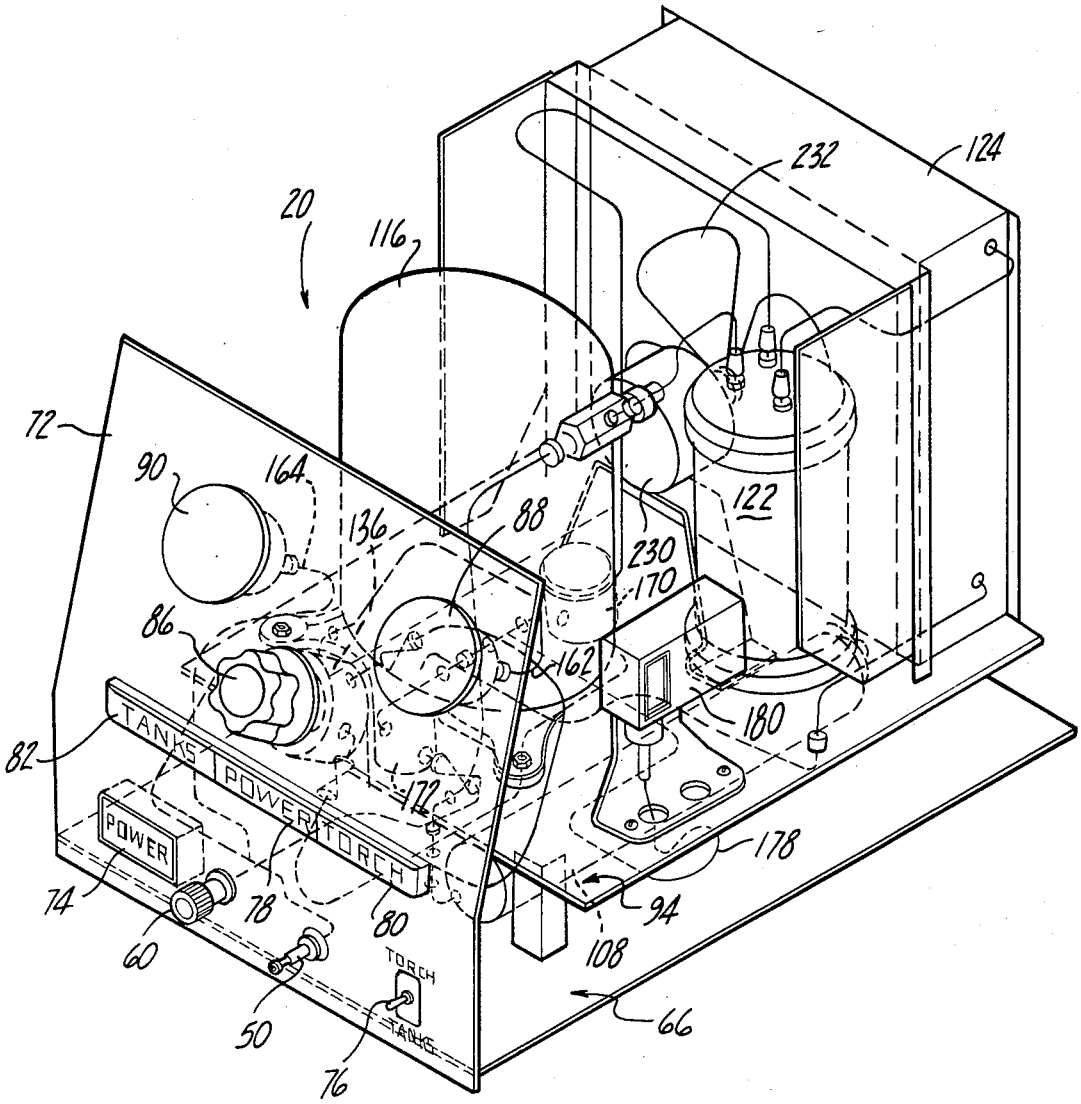
FIG. 3 is a perspective view of the exemplary fueling module of FIG. 1, with portions of its housing removed to reveal many of the internal components thereof.

Referring primarily to FIGS. 1 through 3, the various internal components of the fueling module 20 are contained within the housing 66 and are mounted or otherwise interconnected with a chassis structure 94. The housing 66 and the chassis 94 are preferably designed for providing suitable durability for the fueling module 20 consistent with its intended purposes. However, as is readily apparent to those skilled in the art, the various components and structural configurations of the fueling module 20 should be as light-weight and compact in size as is practicable in order to provide maximum transportability and thereby greatly add to the overall utility of the fueling module 20. In this regard, one early prototype of the fueling module 20 was constructed with overall approximate dimensions of 14 inches (35.6 cm) in width, 28 inches (71.1 cm) in depth, and 15.5 inches (39.4 cm) in height, and weighed approximately 75 pounds (34 kg) in weight. It is envisioned, however, that the overall dimensions and weight of commercial versions of the fueling module 20 can be significantly reduced, without significantly affecting the durability, quality, and utility of the fueling module 20.

Referring primarily to the schematic flow diagram of FIG. 4, but with additional reference to FIG. 3, the internal components, and the operation, of the fueling module 20 will now be described. The ultimate source of gaseous fuel for the fueling module 20 is a gaseous fuel supply system, indicated diagrammatically at reference numeral 100 in FIG. 4. The gaseous fuel supply system 100 can consist of virtually any readily-available source of gaseous fuel, but which most preferably consists of a typical natural gas supply system of the type commonly found in many residential or commercial installations. Such natural gas supply systems typically provide natural gas at pressures generally in the range of approximately ¼ psig (172 kPa) to approximately 10 psig (69 kPa), depending upon the location and supplier of the natural gas supply system, and upon whether such supply system is provided for residential or commercial use.

The fueling module 20 includes a quick-connect connector 102 for selectively and releasably connecting an inlet conduit 104 in fluid communication with the supply system 100. The inlet conduit 104 preferably includes a solenoid-operated inlet valve 106, a filter 108, and a one-way check valve 110. The filter 108 can comprise any of a number of known filter apparatuses suitable for use with the particular gaseous fuel being supplied, but preferably includes a dessicant filter for removing moisture or other undesirable materials from the gaseous fuel. Although various types of dessicant filters may be employed, one preferred dessicant filter 108 employs a sorbent (absorbent or adsorbent) material, such as an activated carbon, a zeolite material, a silica gel-type material, or various clays, for example.

The gaseous fuel, which preferably consists of natural gas, is supplied through the inlet conduit 104, a tee fitting 112, and the other components described above to a compressor intake 114 of a compressor device 116, which is selectively energizable for compressing the gaseous fuel in order to increase its pressure. In the actually-constructed prototype embodiment of the fueling module 20 described above, the compressor 116 was a hermetically-sealed gas compressor of the type commonly employed in refrigeration apparatuses. Such compressors are inexpensive, durable, and readily available as off-the-shelf items. One skilled in the art will readily recognize, of course, that other types of compressors may alternatively be used. Preferably, however, the compressor 116 compresses the gaseous fuel to a pressure generally in the range of approximately 100 psig (689 kPa) to approximately 500 psig (3450 kPa), depending upon the preselected parameters discussed below and the demands of the particular application.

The compressed gaseous fuel is forcibly conveyed from a compressor discharge 118 through a conduit 120 to a compressor lubricant separator 122. The lubricant separator 122 can comprise any of a number of known separator or filter-type devices adapted to remove lubricating oils or liquids from a gas stream passing therethrough. Preferably, the lubricant separator 122 is of the well-known gravity, capillary tube type and is adapted to return the collected compressor lubricants to the compressor intake 114 through a lubricant return conduit 188, under the motivating force of the compressor discharge gas pressure.

From the lubricant separator 122, the compressed gaseous fuel is preferably conveyed through a condenser or heat exchanger 124 for reducing the temperature of the compressed gaseous fuel. The heat exchanger 124 preferably comprises a cooling coil, over which ambient air is forced by a cooling fan 232. In the actually-constructed prototype embodiment of the refueling module 20 described above, the temperature of the gaseous fuel, which was natural gas, entering the heat exchanger 124 was approximately 140 F. (60 C.) and the natural gas temperature on the outlet of the heat exchanger 124 was substantially at ambient temperature. Although the heat exchanger 124 has been depicted in the drawings as comprising the air-to-gas cooling coil apparatus described above, one skilled in the art will readily recognize that other types of heat exchangers, condensers or other cooling apparatuses may alternately be employed to reduce the temperature of the compressed gaseous fuel from the compressor discharge 118 of the compressor 116.

From the heat exchanger 124, the compressed and cooled gaseous fuel is conveyed through a conduit 126 to a tee fitting 129, at which the compressed gaseous fuel can then be discharged from the fueling module 20 through either of two alternate fueling module discharge systems, as illustrated in FIGS. 1 and 2. In the first fueling module discharge system, the compressed gaseous fuel is conveyed from the tee fitting 129 through a preferably solenoid-operated torch valve 130, a first discharge conduit 132, and a tee fitting 134 to an adjustable regulator 136. The adjustable regulator 136 can comprise any of a number of commonly-available adjustable regulator devices operable for preselectively adjusting the pressure of a gas flowing therethrough. The adjustable regulator 136 is selectively operable by way of the above-mentioned pressure regulator control 86 on the control panel 72 in order to preselectively discharge gaseous fuel at a preselectively adjusted discharge pressure through the torch discharge fitting 50 by way of a one-way check valve 140.

The fueling module 20 also preferably includes an adjustable relief valve 184 connected, by way of the tee fitting 134, in fluid communication with the inlet side of the adjustable regulator 136 in order to allow the selected pre-setting of the pressure limit for the adjustable regulator device 136. Because the compressor 116 is typically a constant-speed, constant-output compressor, it discharges a substantially continuous and constant compressed gaseous fuel output whenever it is energized. Thus, any excess output capacity of the compressor 116 must be returned to the compressor intake 114 by way of the relief valve 184 and a gas return conduit 186, which is connected in fluid communication with the compressor intake 114 by way of the tee fitting 112.

Because of the adjustable relief valve arrangement discussed above, the fueling module 20 can be selectively pre-set, by way of adjustment of the relief valve 184, for a maximum gaseous fuel discharge pressure through the above-described first fueling module discharge system that cannot be exceeded by operation of the adjustable regulator device 136. The provision of the above features in the fueling module 20 thereby allows for an infinite preselected adjustment or variation of the fueling module discharge pressure for the torch mode of operation, with infinitely adjustable limits thereon, within the ranges of adjustability of the adjustable regulator device 136 and the relief valve 184, and within the maximum discharge capabilities of the compressor 116. In order to allow the fueling module user to monitor the pressure at which the gaseous fuel is supplied in the torch mode of operation, a tee fitting 138 is provided on the outlet side of the adjustable regulator device 136 in fluid communication, through a conduit 162, with the above-discussed torch pressure indicator 88.

For the optional alternate mode of operation of the fueling module 20, such as for the storage vessel recharging shown for purposes of illustration in FIG. 2, the tee fitting 129 is also connected to a second fueling module discharge system by way of a second discharge conduit 152 and a preferably solenoid-operated tank valve 154. Compressed gaseous fuel in the second fueling module discharge system is conveyed directly from the tank valve 154, through a one-check valve 156, a second discharge conduit 158, and a tee fitting 160, to the above-discussed tank discharge fitting 60. As is readily apparent in FIG. 4, the second fueling module discharge system supplies compressed gaseous fuel to the tank discharge fitting 60, without passing through the adjustable regulator device 136 of the first fueling module discharge system. This is because the discharge pressure in tank recharging is desired to be held below a pre-set maximum level in order to avoid overpressuring the tanks. In order to allow the operator to observe the pressure at which compressed gaseous fuel is discharged through the tank discharge fitting 60, thereby allowing the user to monitor the recharging operation for example, a conduit 164 is connected in fluid communication with the above-mentioned tee fitting 160 and with the above-mentioned tank pressure indicator 90 on the control panel 72.

In order to provide a pre-set maximum compressor discharge pressure, as well as providing for a fail safe feature in the event of a system malfunction, the fueling module 20 preferably also includes a tee fitting 177 in the second discharge conduit 152, which provides fluid communication by way of a compressor control conduit 178 to a pressure cut-off controller device 180. The pressure cut-off device 180 is preselectively and adjustably pre-settable for a maximum overall compressor discharge pressure and, as will be described in more detail below, is capable of de-energizing the compressor 116 by way of a control conduit 182 interconnecting the pressure cut-off 180 and the drive motor (not shown) of the compressor 116. The pressure cut-off device 180 can be adjustably pre-set in order to provide upper limits on the gaseous fuel discharge pressure through either of the fueling module discharge systems, as well as providing automatic shut-off of the compressor 116 in the event of down-stream conduit or hose ruptures, or various other malfunctions in which compressor de-energization is necessary or desirable. It is preferred that once the pressure cut-off controller 180 has de-energized the compressor 16, it can be reset to resume operations only by a manual resetting procedure in order to encourage the user to ascertain the cause of the compressor de-energization and correct any malfunctions prior to resuming operations.

Figure 4:
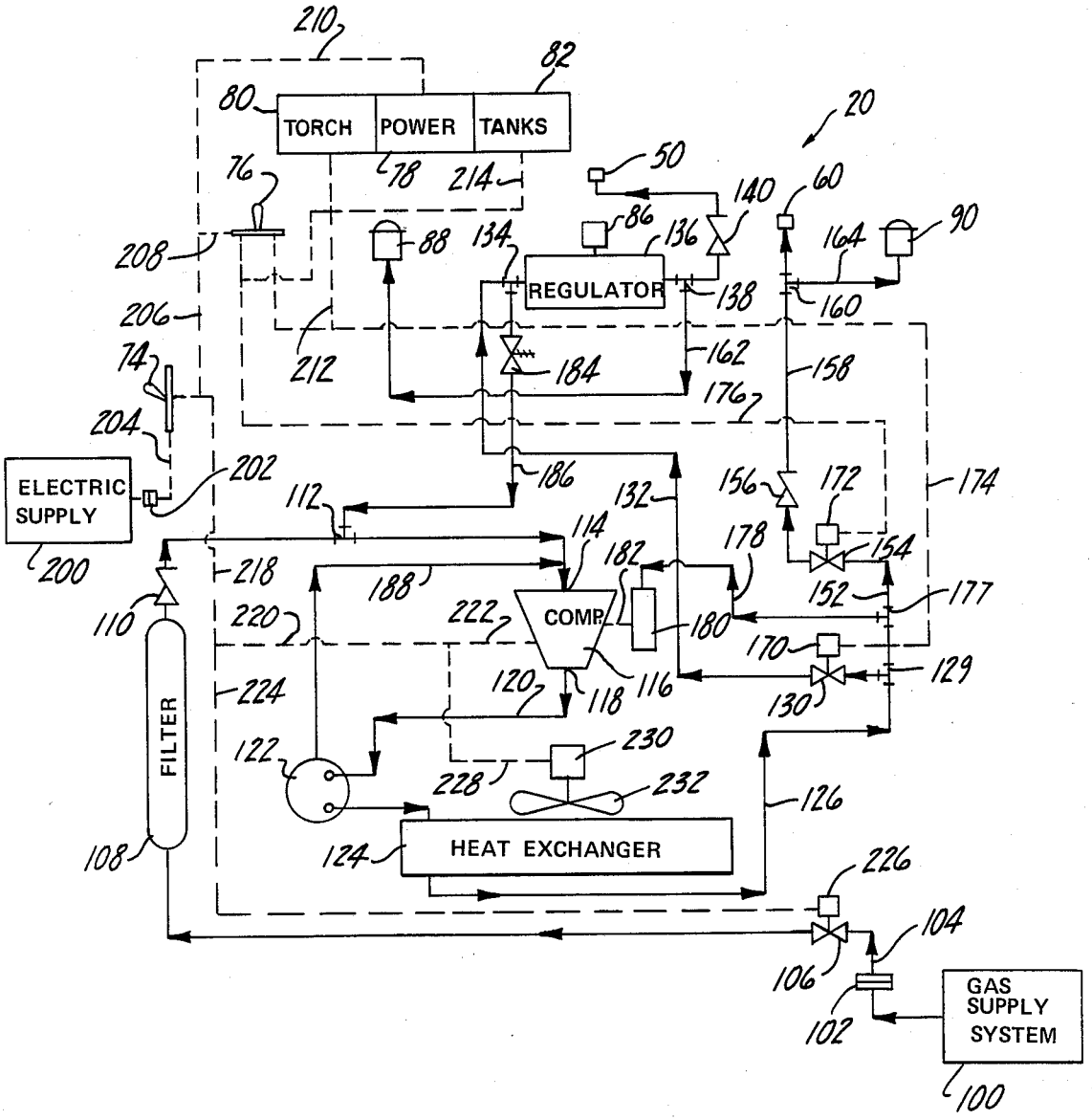
FIG. 4 is a schematic flow diagram of the exemplary refueling apparatus of FIG. 1.

In order to provide for the various functions and features described above, the fueling module 20 includes a power and control system, shown diagrammatically in FIG. 4, for energizing, de-energizing, and controlling the various components. The fueling module 20 is preferably electrically powered and is releasably connectable with a conventional external electrical power source 200 by way of a conventional electrical connector 202. Electrical energy is conveyed by way of an electrical supply line 204 to the above-described main power switch 74, which is selectively operable to either an "on" position or an "off" position.

When the main power switch 74 is in its "on" position, electrical energy is conducted by way of an electrical feed line 206 and a power indicator feed line 210 to the above-described power indicator light 78 on the control panel 72, thereby providing indication to the operator that the fueling module 20 is energized. Electrical power is also supplied through the main power switch 74, the electrical feed line 206, and a selector switch feed line 208 to the above-mentioned selector switch 76 for purposes that will be described in more detail below. The main power switch 74 is also the vehicle for supplying electrical power by way of other electrical feed lines 218 and 220 and a compressor feed line 222 to the motor drive (not shown) for the compressor 116, thereby allowing the compressor 116 to be selectively energized and de-energized through the main power switch 74. The electrical feed line 218 also branches off into an inlet solenoid feed line 224 in order to energize an inlet solenoid operator 226 for purposes of opening the inlet valve 106 when the system is energized, or for closing the inlet valve 106 when the system is de-energized.

A fan motor feed line 228 is also provided for supplying electrical power from the main power switch 74 to the fan motor 230 of the heat exchanger fan 232. Thus, the compressor 116, the fan motor 230 and the fan 232, and the solenoid-operated inlet valve 106 are all energized and de-energized, along with the selector switch 76 and the power indicator light 78, by way of operation of the main power switch 74.

Once the fueling module 20 has been energized so that the selector switch 76 is energized, the selector switch 76 can be selectively operated to the so-called "torch" position in order to energize the first solenoid operator 170 on the torch valve 130, by way of a first electrical control line 174. Similarly, if the selector switch 76 is moved to the so-called "tank" position, a second solenoid operator 172 is energized by way of a second electrical control line 176 for purposes of opening the above-mentioned solenoid-operated tank valve 154. Therefore, when the selector switch 76 is moved to the so-called "torch" position, the solenoid operator 170 is energized to open the torch valve 130, and substantially simultaneously, the solenoid operator 172 is de-energized so as to close the tank valve 154. Conversely, when the selector switch is moved to the so-called "tank" position, the solenoid operator 172 is energized to open the tank valve 154, and substantially simultaneously, the solenoid operator 170 is de-energized to close the torch valve 130. By such an arrangement, the fueling module 20 can be employed for discharging compressed gaseous fuel, preferably natural gas, either through the first fueling module discharge system for purposes of tank operation, or through the second fueling module discharge system for purposes of storage vessel recharging or other such applications.

In order to provide the user with an indication of whether the "torch" or "tank" mode has been selected, an electrical torch indicator feed line 214 is electrically interconnected to provide power from the first electrical control line 174 to the torch indicator light 80. Similarly, an electrical tank indicator feed line 212 supplies electrical power between the second electrical control line 176 and the tank indicator light 82.

The operation of the fueling module 20 can be briefly and generally described by starting with the appropriate interconnection of the fueling module 20 for the desired mode of operation either for the torch assembly 16, as shown in FIG. 1, or for the storage vessels 64, as shown in FIG. 2. The fueling module 20 can then be interconnected with the gaseous fuel supply system 100 by way of the quick-connect connector 102, followed by electrical interconnection with the electrical power source 200 by way of the electrical connector 202.

When the main power switch 74 is moved to its "on" position, the power indicator light 78, the selector switch 76, the compressor 116, the fan motor 230, and the inlet solenoid operator 226 are all energized in order to open fluid communication with the gaseous fuel supply system 100 and to start the fueling module 20. Depending upon which position of the selector switch 76 has been selected, the appropriate torch indicator light 80, or the tank indicator light 82, is also energized and illuminated.

When the main power switch 74 has been moved to its "on" position, and the selector switch 76 is moved to the "torch" mode position, the torch valve 130 is opened, and the tank valve 154 is simultaneously closed. This condition allows the compressed gaseous fuel to be supplied through the first fueling module discharge system to the torch assembly 16, with the discharge pressure being selectively adjusted and controlled by the adjustable regulator 136 and its torch pressure regulator control 86. Such discharge pressure regulation can be accomplished within the pre-set limits imposed on the first fueling module discharge system by the preferably manually adjustable relief valve 184, as described above.

Similarly, when the selector switch 76 is moved to the "tank" position, the tank valve 154 is opened, and the torch valve 130 is substantially simultaneously closed, in order to discharge compressed gaseous fuel through the second fueling module discharge system substantially directly to the storage vessel 64 or for other fuel-using applications. As mentioned above, the fueling module discharge pressure in either of the above-described modes of operation is ultimately governed by the selectively pre-set maximum compressor discharge pressure setting of the preferably manually adjustable pressure cut-off device 180.

Conversely, when the main power switch 74 is moved to its "off" position, the above-described components are de-energized in order to shut down the entire fueling module 20. In this regard, it should be noted that remains in the fueling module 20 due to the fact that there is no provision for internal storage of compressed natural gas. This feature significantly adds to the safety of the fueling module 20 by substantially avoiding the build-up of pressurized gaseous fuel therein during periods of non-use.

In order to provide examples of suitable components for the exemplary fueling module 20, a chart is set forth below, wherein many of the major components of the fueling module 20 are identified either generically or by supplier or other relevant product information, accompanied by appropriate trade names or trademarks where applicable. It should be emphasized that the information provided below is merely exemplary, and that one skilled in the art will readily recognize that a wide variety of equivalent or alternate components may also be employed.

| Component Reference Numeral | Description |
|---|---|
| 50 | Brass CGA Hose Adapter/Fitting |
| 60 | "Swagelok" SS-QC4-B-4PF Female, Single End, Shut-Off Quick-Connector |
| 76 | 15 Amp, 115 V, DPDT Selector Switch |
| 88 | "Wika" 111.10, 2½ Inch, 0–30 Psi, CBM/U-C Pressure Gauge |
| 90 | "Wika" 111.10, 2½ Inch, 0–400 Psi, CBM/U-C Pressure Gauge |
| 106 | "Valcor" SV-62, Normally Closed Solenoid Valve, ¼ Inch Port Diameter, 115 V., 60 Hz. |
| 108 | Dessicant-filled Moisture Separator/Filter Assembly |
| 116 | "Copeland" JRL4-0050-IAA Welded Hermetic Compressor |
| 122 | "AC&R Components" S-5580 Oil Separator |
| 124 | Heat Exchanger, Double Row, 575 Psig, W.P. |
| 130/154 | "Valcor" SV-12, Normally Closed Solenoid Valve, ¼ Inch Port Diameter, 115 V., 60 Hz. |
| 136 | "Tescom" Hand-Loaded Pressure Reducing Regulator, 0–50 Psig Outlet |
| 140 | "Nupro" 4CP In-line Check Valve |
| 184 | "Nupro" 4CPA Adjustable In-Line Relief Valve |
| 230 | "Steveco" Fan Motor Assembly 9W-CCW, 115 V., 60 Hz. |

The foregoing discussion discloses and describes exemplary embodiments of the present invention. One skilled in the art will readily recognize from such discussion, and from the accompanying drawings, that various changes, modifications and variations may be made therein without departing from the spirit and scope of the invention as defined in the following claims.

What is claimed is:

1. A fueling module for supplying natural gas to a natural gas fueled torch apparatus including a torch adapted for use in cutting or welding operations, the torch apparatus further including a source of oxygen for supplying oxygen to the torch, and the torch being selectively operable for combustion of a mixture of natural gas and oxygen, said fueling module connectable to an electric power source and being supplying natural gas to said torch apparatus at an elevated pressure from a relatively low pressure natural gas supply system, said fueling module comprising:

fueling module inlet means connectable in fluid communication with said natural gas supply system;

compression means in fluid communication with said fueling module inlet means and selectively energizable for compressing said natural gas from said natural gas supply system in order to increase its pressure, said compression means having a compression intake in fluid communication with said fueling module inlet means and a compression discharge outlet for discharging compressed natural gas from said compression means;

lubricant filter means in fluid communication with said compression discharge outlet for substantially trapping and collecting compression means lubricants from said compressed natural gas from said compression discharge outlet and for returning said collected compression means lubricants to said compression intake;

cooling means in fluid communication with said compression discharge outlet means for reducing the temperature of said compressed natural gas therefrom;

first fueling module discharge means selectively and releasably connectable to the torch apparatus for selectively supplying said compressed natural gas from said compression means to said torch apparatus, said first fueling module discharge means including adjustable regulator means in fluid communication with said compression discharge outlet and operable for preselectively adjusting the pressure of said compressed natural gas from said compression means in order to supply said compressed natural gas to said torch apparatus at a preselectively adjusted fueling module discharge pressure;

second fueling module discharge means in fluid communication with said compression discharge outlet for selectively bypassing said adjustable regulator means and for discharging said compressed natural gas from said fueling module;

valving means for selectively discharging said compressed natural gas from said compression means through one of said first and second fueling module discharge means, said valving means including at least one electric solenoid-operated valve in each of said first and second fueling module discharge means, and a selector switch selectively energizable and operable for operating said solenoid valves to substantially simultaneously open either one of said solenoid-operated valves while closing the other of said solenoid-operated valves in order to selectively discharge said compressed natural gas through the corresponding one of said first and second fueling module discharge means;

preselectively adjustable cut-off means for automatically de-energizing said compression means when the natural gas from said compression discharge outlet reaches a preselected maximum compression discharge pressure; and preselectively adjustable relief valve means for returning a portion of said natural gas from said first fueling module discharge means to said compression intake when the pressure of said natural gas in said first fueling module discharge means reaches a preselected relief pressure level, said preselectively adjusted fueling module discharge pressure being substantially limited to a pressure level no greater than said preselected relief pressure and no greater than said preselected maximum compression discharge pressure.

2. A fueling module according to claim 1, wherein said compression means includes a hermetically-sealed gas compressor.

3. A fueling module according to claim 1, wherein said natural gas in said natural gas supply system is at a pressure generally in the range of approximately ¼ psig (1.72 kPa) to approximately 10 psig (69 kPa), said compression means increasing the pressure of said natural gas to a pressure less than approximately 500 psig (3450 kPa), said fueling module inlet means including means for selectively and releasably connecting said fueling module to said natural gas supply system.

4. A fueling module according to claim 1, wherein said cooling means comprises an air-to-natural gas heat exchanger.

5. A fueling module according to claim 1, wherein said second fueling module discharge means includes means for selectively and releasably connecting said discharge means to at least one natural gas storage vessel in order to allow said storage vessel to be selectively filled from said relatively low pressure natural gas supply system by said fueling module.

6. A fueling module according to claim 1, wherein said fueling module is housed within an enclosure as a self-contained portable unit separable from said torch means and said oxygen supply means.

7. A fueling module according to claim 1, wherein each of said first and second fueling module discharge means includes a natural gas pressure indicator for monitoring the pressure of said compressed natural gas being selectively discharged through either of said first and second fueling module discharge means.

8. A fueling module according to claim 1, wherein said fueling module further includes a main power switch for selectively energizing and de-energizing said compression means, said selector switch, and said cooling means.

9. A fueling module according to claim 8, wherein said fueling module further includes electrical indicator means for indicating either of an energized or de-energized condition for said compression means, said selector switch, and said cooling means, and for indicating which of said solenoid-operated valves in said first and second fueling module discharge means is open and which of said solenoid-operated valves is closed, said electrical indicator means also being selectively energized or de-energized by said main power switch.

10. A fueling module according to claim 9, wherein said cut-off means includes means for substantially preventing said de-energized compression means from being re-energized until said cut-off is manually reset.

11. A fueling module according to claim 10, wherein said fueling module inlet means includes a solenoid-operated inlet valve means selectively energizable by said main power switch for providing said fluid communication with said natural gas supply system and selectively de-energizable by said main power switch for substantially preventing said fluid communication with said natural gas supply system.

* * * * *

UNITED STATES PATENT AND TRADEMARK OFFICE

CERTIFICATE OF CORRECTION

PATENT NO. : 4,776,366

DATED : October 11, 1988

INVENTOR(S) : Kenneth S. Czerwinski et al.

It is certified that error appears in the above-identified patent and that said Letters Patent is hereby corrected as shown below:

ON THE ABSTRACT Line 12 "fuelilng" should be --fueling—;

Col. 1, Line 15, insert "a" after —of—;

Col. 1, line 19, delete "B" after —No.—;

Col. 5, line 4, "(172 kPa)" should be —(1.72 kPa)—;

Col. 7, line 2, "one-check" should be —one-way check—;

Col. 7, line 42, "16" should be —116—;

Col. 9, line 37, insert "no fuel" after —that—;

Col. 10, line 31, insert "being" after —module—;

Col. 10, line 32, delete "being" after —and—.

Signed and Sealed this

Sixth Day of June, 1989

*Attest:*

*Attesting Officer*

DONALD J. QUIGG

*Commissioner of Patents and Trademarks*